US008563920B2

(12) United States Patent
Okumura et al.

(10) Patent No.: US 8,563,920 B2
(45) Date of Patent: Oct. 22, 2013

(54) MASS SPECTROMETER

(75) Inventors: Daisuke Okumura, Kyoto (JP); Hiroto Itoi, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 170 days.

(21) Appl. No.: 13/159,974

(22) Filed: Jun. 14, 2011

(65) Prior Publication Data

US 2011/0240851 A1 Oct. 6, 2011

Related U.S. Application Data

(63) Continuation of application No. 12/440,324, filed as application No. PCT/JP2007/001438 on Dec. 20, 2007, now Pat. No. 7,985,951.

(51) Int. Cl.
*H01J 49/00* (2006.01)

(52) U.S. Cl.
USPC ..... 250/281; 250/282; 250/289; 250/290; 250/293

(58) Field of Classification Search
USPC ..... 250/281, 282, 289, 290, 293
See application file for complete search history.

(56) References Cited

U.S. PATENT DOCUMENTS

| | | | | |
|---|---|---|---|---|
| 2,896,083 | A * | 7/1959 | Hare et al. | 250/293 |
| 5,847,386 | A * | 12/1998 | Thomson et al. | 250/288 |
| 6,177,668 | B1 * | 1/2001 | Hager | 250/282 |
| 6,417,511 | B1 * | 7/2002 | Russ et al. | 250/292 |
| 6,462,338 | B1 | 10/2002 | Inatsugu et al. | |
| 6,730,904 | B1 * | 5/2004 | Wells | 250/292 |
| 6,812,453 | B2 | 11/2004 | Bateman et al. | |
| 7,391,021 | B2 * | 6/2008 | Stoermer et al. | 250/292 |
| 7,569,811 | B2 * | 8/2009 | Javahery et al. | 250/282 |

(Continued)

FOREIGN PATENT DOCUMENTS

| | | | |
|---|---|---|---|
| DE | 199 41 670 | A1 | 3/2000 |
| EP | 1465234 | A2 | 10/2004 |

(Continued)

OTHER PUBLICATIONS

Andrew N. Krutchinsky, et al., "A novel high-capacity ion trap-quadrupole tandem mass spectrometer"International Journal of Mass Spectrometry, 2007, pp. 93-105, vol. 268.

(Continued)

*Primary Examiner* — Michael Maskell
(74) *Attorney, Agent, or Firm* — Sughrue Mion, PLLC

(57) ABSTRACT

A radio-frequency ion guide (20) for converging ions by a radio-frequency electric field and simultaneously transporting the ions into the subsequent stage is composed of eight rod electrodes (21 through 28) arranged in such a manner as to surround an ion optical axis (C). Each of the rod electrodes (21 through 28) is disposed at a tilt with respect to the ion optical axis (C) so that the radius r2 of the inscribed circle (29*b*) at the end face of the ion exit side is larger than the radius r1 of the inscribed circle (29*a*) at the end face of the ion injection side. Accordingly, the gradient of the magnitude or depth of the pseudopotential is formed in the ion's traveling direction in the space surrounded by the rod electrodes (21 through 28). Ions are accelerated in accordance with this gradient. Therefore, even in the case where the gas pressure is relatively high and ions have many chances to collide with gas, it is possible to moderate the ions' slowdown and prevent the ions' delay and stop.

16 Claims, 4 Drawing Sheets

(56) References Cited

U.S. PATENT DOCUMENTS

| | | | | |
|---|---|---|---|---|
| 2003/0001088 | A1* | 1/2003 | Bateman et al. | 250/287 |
| 2005/0199802 | A1 | 9/2005 | Ueno | |
| 2005/0253064 | A1* | 11/2005 | Loboda et al. | 250/292 |
| 2005/0258354 | A1 | 11/2005 | Baba et al. | |
| 2006/0076485 | A1* | 4/2006 | Stoermer et al. | 250/290 |
| 2007/0114392 | A1* | 5/2007 | Mukaibatake | 250/290 |
| 2009/0218484 | A1* | 9/2009 | Javahery et al. | 250/282 |

FOREIGN PATENT DOCUMENTS

| | | | |
|---|---|---|---|
| EP | 17630062 | A2 | 3/2007 |
| GB | 2341270 | A | 3/2000 |
| JP | 07-201304 | A | 8/1995 |
| JP | 11-510946 | A | 9/1999 |
| JP | 2000-149865 | A | 5/2000 |
| JP | 2005-259481 | A | 9/2005 |
| JP | 2006-525643 | A | 11/2006 |
| JP | 2006-332003 | A | 12/2006 |
| JP | 2007-128694 | A | 5/2007 |
| WO | 97/07530 | A1 | 2/1997 |
| WO | 2004-100209 | A2 | 11/2004 |
| WO | 2007079588 | A1 | 7/2007 |

OTHER PUBLICATIONS

Japanese Office Action dated Apr. 5, 2011, for the corresponding Japanese Patent Application No. 2008-549302.

Extended European Search Report dated Mar. 18, 2011, for the corresponding European Patent Application No. 07849868.0.

Section 7.1.2 Chemical Ionization Ion Sources, in Jurgen H. Gross: "Mass Spectrometry a Textbook", 2004, Springer Verlag, Berlin etc., XP00262799.

Written Opinion of the International Searching Authority dated Feb. 12, 2008, issued in corresponding International Application No. PCT/JP2007/001438.

Japanese Office Action dated Jul. 12, 2011, issued in corresponding Japanese Patent Application No. 2008-549302.

European Office Action dated Jun. 13, 2013 issued in European Patent Application No. 07849868.0.

* cited by examiner

MASS SPECTROMETER

CROSS-REFERENCE TO RELATED APPLICATION

This is a Continuation Application of application Ser. No. 12/440,324, filed Mar. 6, 2009, which is a National Stage entry of PCT/JP2007/001438 filed Dec. 20, 2007, the disclosure of which is hereby incorporated by reference in its entirety.

TECHNICAL FIELD

The present invention relates to a mass spectrometer. More precisely, it relates to an ion transport optical system for transporting an ion into the subsequent stage under a relatively high gas pressure.

BACKGROUND ART

A well-known mass-analyzing method for identifying a substance having a large molecular weight and for analyzing its structure is an MS/MS analysis (or tandem analysis). FIG. 11 is a schematic configuration diagram of a general MS/MS mass spectrometer disclosed in Patent Documents 1 and other documents.

In this MS/MS mass spectrometer, three-stage quadrupole electrodes 12, 13, and 15 each composed of four rod electrodes are provided, inside the analysis chamber 10 which is vacuum-evacuated, between an ion source 11 for ionizing a sample to be analyzed and a detector 16 for detecting an ion and providing a detection signal in accordance with the amount of ions. A voltage $\pm(U1+V1\cdot\cos\omega t)$ is applied to the first-stage quadrupole electrodes 12, in which a direct current U1 and a radio-frequency voltage V1·cos ωt are synthesized. Due to the action of the electric field generated by this application, only a target ion having a specific mass-to-charge ratio m/z is selected as a precursor ion from among a variety of ions generated in the ion source 11 and passes through the first-stage quadrupole electrodes 12.

The second-stage quadrupole electrodes 13 are placed in the well-sealed collision cell 14, and Ar gas for example as a CID gas is introduced into the collision cell 14. The precursor ion sent into the second-stage quadrupole electrodes 13 from the first-stage quadrupole electrodes 12 collides with Ar gas inside the collision cell 14 and is dissociated by the collision-induced dissociation to produce a product ion. Since this dissociation has a variety of modes, two or more kinds of product ions with different mass-to-charge ratios are generally produced from one kind of precursor ion, and these product ions exit from the collision cell 14 and are introduced into the third-stage quadrupole electrodes 15. Since not every precursor ion is dissociated, some non-dissociated precursor ions may be directly sent into the third-stage quadrupole electrodes 15.

To the third-stage quadrupole electrodes 15, a voltage $\pm(U3+V3\cdot\cos\omega t)$ is applied in which a direct current U3 and a radio-frequency voltage V3·cos ωt are synthesized. Due to the action of the electric field generated by this application, only a product ion having a specific mass-to-charge ratio is selected, passes through the third-stage quadrupole electrodes 15, and reaches the detector 16. The direct current voltage U3 and radio-frequency voltage V3·cos ωt which are applied to the third-stage quadrupole electrodes 15 are appropriately changed, so that the mass-to-charge ratio of an ion capable of passing the third-stage quadrupole electrodes 15 is scanned to obtain the mass spectrum of the product ions generated by the dissociation of the target ion.

In a general MS/MS mass spectrometer, the length of the collision cell 14 in the direction along the ion optical axis C which is the central axis of the ion stream is approximately 150 through 200 mm. The gas pressure in the collision cell 14 is a few mTorr and higher than that of the analysis chamber 10 surrounding the collision cell 14. When an ion proceeds in a radio-frequency electric field in the atmosphere of comparatively high gas pressure, the kinetic energy of the ion attenuates due to a collision with the gas, so that the ion decelerates. In an extreme case, a decelerated ion could stop in the radio-frequency electric field.

In the case where an MS/MS mass spectrometer as previously described is used as a detector of a chromatograph such as a liquid chromatograph for example, it is necessary to repeatedly perform an analysis at predetermined intervals of time. Hence, if the ion's time delay is significant due to the speed reduction, an ion which should normally pass through the third-stage quadrupole electrodes 15 might not be able to pass through it, which causes a degradation in the detection sensitivity. In addition, an ion remaining in the collision cell 14 may appear at a timing at which no ion should appear in reality, which causes a ghost peak. Moreover, since it takes time for an ion to reach the detector 16, the time interval of the repeated analysis is required to be previously determined in view of such a situation, which might cause an omission of analysis information in a multi-component analysis.

One conventional and general method for avoiding the previously described various problems is to form a direct current electric field having a potential gradient in the ion's passage direction in the collision cell 14, so that an ion should be accelerated by the action of the direct current electric field. In the mass spectrometer described in Patent Document 2, an electric field having a potential gradient in the direction of the ion optical axis is formed in order to accelerate an ion by the application of a direct current voltage to a radio-frequency ion guide in which each rod electrode has a different tilt to the ion optical axis, or by the application of a direct current voltage to each rod divided in the direction of the ion optical axis. In the mass spectrometer described in Patent Document 3, an ion that is allowed to pass through is accelerated by sequentially applying a pulse voltage to each aperture electrode of a radio-frequency ion guide in which approximately one hundred aperture plates are arranged in the direction of the ion optical axis.

However, if each rod electrode of a radio-frequency ion guide is obliquely disposed at different angles from each other or if an auxiliary electrode is used in order to form a direct current electric field having a potential gradient in the direction of the ion optical axis, a turbulence might occur in the radio frequency electric field appropriate for converging ions, which might deteriorate the ion passing properties. In addition, the configuration of Patent Document 3 has a complex structure, and simultaneously requires a complicated control since a pulse voltage for accelerating an ion should be appropriately controlled in accordance with each mass-to-charge ratio.

In the case where an atmospheric pressure ionization interface is used as in a liquid chromatograph mass spectrometer, a multi-stage differential evacuation system is used for maintaining a high vacuum atmosphere within an analysis chamber, which includes a mass separator and detector. In this case, the gas pressure inside the intermediate vacuum chamber in the subsequent stage of an ionization chamber is relatively high due do the atmosphere flowing from the ionization chamber, which causes the same problem as inside the collision cell as described earlier.

[Patent Document 1] Japanese Unexamined Patent Application Publication No. H07-201304

[Patent Document 2] U.S. Pat. No. 5,847,386

[Patent Document 3] U.S. Pat. No. 6,812,453

DISCLOSURE OF THE INVENTION

Problems to be Solved by the Invention

The present invention has been achieved to solve the aforementioned problems, and the main objective thereof is to provide a mass spectrometer capable of effectively preventing the delay or stagnation of ions with a relatively simple structure in a radio-frequency ion guide which is used under a relatively high gas pressure.

Means for Solving the Problems

To solve the previously-described problem, the present invention provides a mass spectrometer having an ion guide for converging ions by a radio-frequency electric field under a gas pressure of a few mTorr or higher than that and simultaneously transporting the ions into a subsequent stage, wherein the ion guide forms a gradient of a magnitude or depth of a pseudopotential by the radio-frequency electric field along an ion's traveling direction, and an ion is accelerated in the traveling direction in accordance with the gradient.

In the mass spectrometer according to the present invention, the ion guide may be specifically disposed in the following portion for example: the inside of the collision cell into which a collision induced dissociation gas is provided for dissociating ions, or the inside of an intermediate vacuum chamber provided as the first stage of a plurality of intermediate vacuum chambers which comprise a multiple-stage differential evacuation system between an ionization chamber for ionizing a target component under an approximate atmospheric pressure and a mass analysis chamber in which a high vacuum atmosphere is maintained.

In such portions, due to a relatively high gas pressure, ions have more chances to collide with a gas and are particularly likely to decelerate. On the other hand, in the mass spectrometer according to the present invention, the magnitude or depth of the pseudopotential in the ion guide has a monotonic downward gradient along the ion's traveling direction, that is, a falling gradient in which the pseudopotential may maintain the same level at some portions but will never increase at any point. Due to this effect, an ion is given a kinetic energy toward the traveling direction. Accordingly, even if an ion collides with a gas and is thereby decelerated, it is accelerated once again. Therefore, it is possible to moderate the ion's delay in the ion guide, and also prevent an ion from stopping along the way.

The pseudopotential by a radio-frequency electric field is dependent on a parameter such as the radius of the inscribed circle of the ion guide, the number of poles of the ion guide, and the amplitude and frequency of the radio-frequency voltage applied to the ion guide. Hence, any of such parameters may be changed along the direction of the ion optical axis in order to form the pseudopotential's gradient as previously described.

As an embodiment of the mass spectrometer according to the present invention, the ion guide may be composed of a plurality of linearly-extending rod electrodes surrounding an ion optical axis, and each rod electrode may be disposed at a tilt in such a manner that the distance from the ion optical axis increases toward the ion's traveling direction. That is, in this embodiment, the radius of the inscribed circle of the ion guide is increased along the direction of the ion optical axis.

With this configuration, the circuit of the electric system is kept from becoming complicated since it is not necessary to prepare a variety of radio-frequency voltages which have a different amplitude and frequency, for the voltage (i.e. a radio-frequency voltage or a voltage in which a radio-frequency voltage and direct current bias voltage are superimposed) applied to each rod electrode. In addition, all the rod electrodes are simply tilted in a rotationally-symmetrical manner with respect to the ion optical axis and as before, a linearly elongated cylinder (or tube) can be used as the rod electrode itself. Therefore, the structure of the electrode and the structure for holding the electrode are simple.

As another embodiment of the mass spectrometer according to the present invention, the ion guide may be composed of rod electrodes surrounding the ion optical axis, and each rod electrode may have a tilted portion such that the radius of the inscribed circle of the rod electrodes increases toward the ion's traveling direction. In this embodiment, the tilted portion may be either a linear one or curved one.

Also in the case where the ion guide is composed of not a plurality of rod electrodes surrounding the ion optical axis but a plurality of plate electrodes arranged at predetermined intervals in the direction of the ion optical axis, the radius of the inscribed circle can be practically changed. That is, as another embodiment of the mass spectrometer according to the present invention, the ion guide may be composed of a plurality of plate electrodes arranged in the direction of the ion optical axis, and each plate electrode may have a circular opening whose radius centering on the ion optical axis increases toward the ion's traveling direction.

As another embodiment of the mass spectrometer according to the present invention, the ion guide may be composed of a plurality of virtual rod electrodes surrounding the ion optical axis, each virtual rod electrode may be composed of a plurality of short segmented rod electrodes separated in the direction of the ion optical axis, and the plurality of segmented rod electrodes belonging to the same virtual rod electrode may be disposed in such a manner that the distance from the ion optical axis increases toward the ion's traveling direction.

In addition, as another embodiment of the mass spectrometer according to the present invention, the ion guide may be composed of a plurality of virtual rod electrodes surrounding the ion optical axis, each virtual rod electrode may be composed of a plurality of short segmented rod electrodes separated in the direction of the ion optical axis, and a radio-frequency voltage whose amplitude or frequency is different may be applied to the plurality of segmented rod electrodes belonging to the same virtual rod electrode. That is, with this configuration, the radio-frequency electric field's amplitude or frequency is changed in the ion's passage direction in order to form the gradient of the magnitude or depth of the pseudopotential.

Furthermore, as another embodiment of the mass spectrometer according to the present invention, the ion guide may be composed of a plurality of virtual rod electrodes surrounding the ion optical axis, each virtual rod electrode may be composed of a plurality of short segmented rod electrodes separated in the direction of the ion optical axis, and the plurality of segmented rod electrodes belonging to the same virtual rod electrode may have a different cross-sectional shape. With the change of the segmented rod electrodes' cross-sectional shape, the pseudopotential terms of the different number of poles are superimposed. Hence, the shape of the pseudopotential well changes in the ion's passage direction.

Effects of the Invention

With the mass spectrometer according to the present invention, even in the case where an ion comes in contact with a collision induced dissociation gas inside the collision cell and the kinetic energy is decreased for example, the precursor ion and the product ions generated by a dissociation are assisted in their progress, which can prevent the ions' substantial delay inside the collision cell. Consequently, the amount of the target ions to be selected in the mass separator in the subsequent stage is increased, which improves the detection sensitivity. Simultaneously, the appearance of a ghost peak on the mass spectrum can also be prevented since an ion's stagnation inside the collision cell and intermediate vacuum chamber can be prevented.

EXPLANATION OF NUMERALS

10 . . . Ionization Chamber
11 . . . Ion Source
12 . . . First-Stage Quadrupole Electrodes
14 . . . Collision Cell
15 . . . Third-Stage Quadrupole Electrodes
16 . . . Detector
20, 40, 50, 60, 70, 80, 90 . . . Radio-Frequency Ion Guide
21 through 28 . . . Rod Electrode

BEST MODES FOR CARRYING OUT THE INVENTION

First Embodiment

Figure 1:
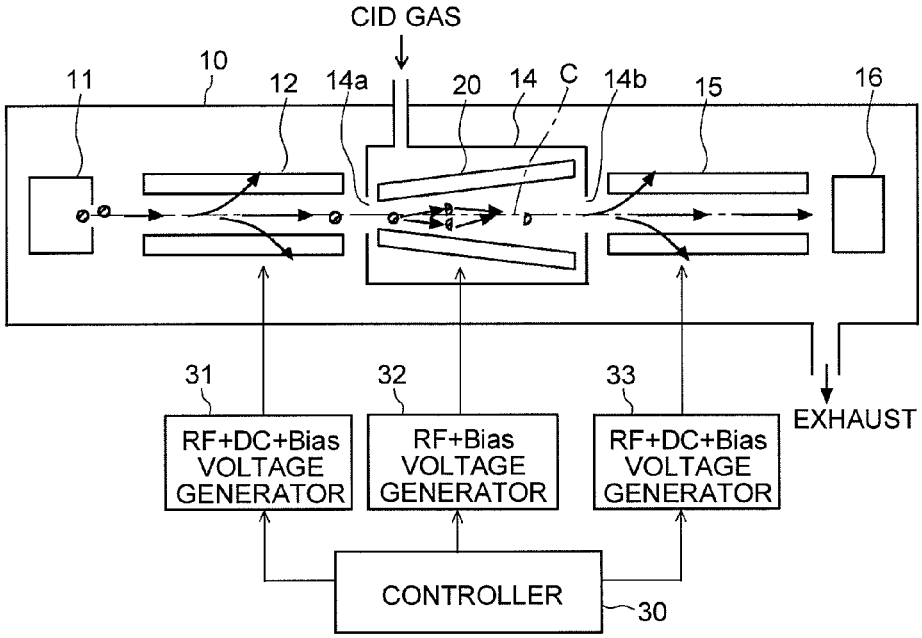
FIG. 1 is a schematic overall configuration diagram of an MS/MS mass spectrometer according to an embodiment (the first embodiment) of the present invention.
Figure 2:
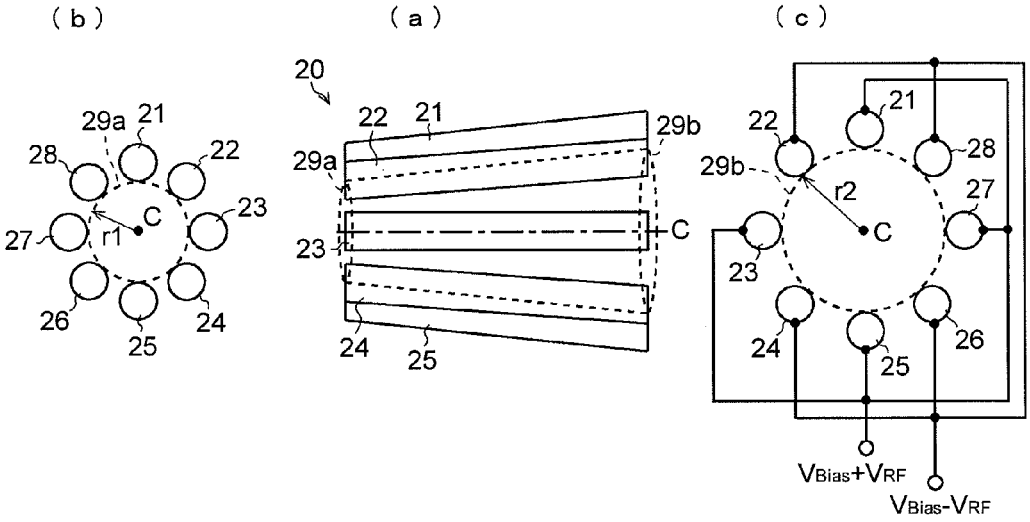
FIG. 2 illustrates a radio-frequency ion guide in the MS/MS mass spectrometer according to the first embodiment: (a) front elevational view, (b) left side elevational view, and (c) right elevational view.
Figure 11:
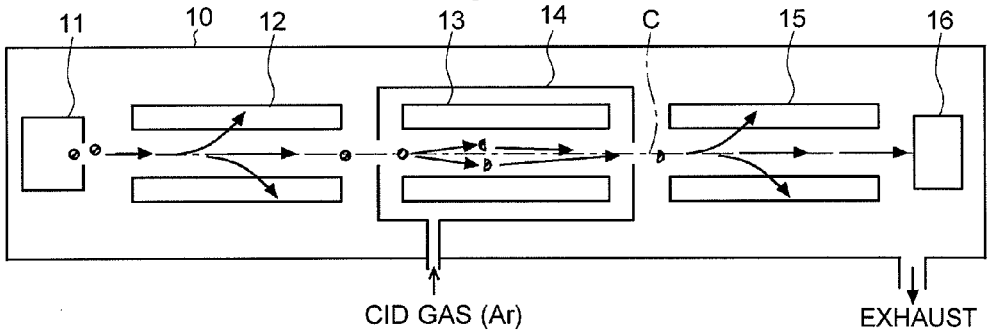
FIG. 11 is an overall configuration diagram of a conventional and general MS/MS mass spectrometer.

An MS/MS mass spectrometer which is an embodiment (the first embodiment) of the present invention will be described with reference to the figures. FIG. 1 is an overall configuration diagram of the MS/MS mass spectrometer according to this embodiment, and FIG. 2 is an external view of an ion guide provided in the collision cell in the MS/MS mass spectrometer of the present embodiment. The same components as in the conventional configuration as illustrated in FIG. 11 are indicated with the same numerals and the detailed explanations are omitted.

In the MS/MS mass spectrometer of the present embodiment, as in the conventional configuration, a collision cell 14 is provided between the first-stage quadrupole electrodes 12 and the third-stage quadrupole electrodes 15 in order to generate a variety of product ions by dissociating a precursor ion. This collision cell 14 is an almost hermetically-closed structure except for an ion injection aperture 14*a* and ion exit aperture 14*b*: for example, a structure whose surrounding face is an approximately cylindrical form and both end faces are almost closed. Inside the collision cell, a radio-frequency ion guide 20 is provided in which eight cylindrically-shaped rod electrodes are placed in such a manner as to surround an ion optical axis C.

Under the control of a controller 30, a voltage of ±(U1+V1·cos ωt)+Vbias1 is applied to the first-stage quadrupole electrodes 12 from the RF (radio-frequency) +DC (direct current voltage for mass separation) +Bias (bias direct current voltage) voltage generator 31, in which a predetermined direct current bias voltage Vbias1 is further added to a voltage of ±(U1+V1·cos ωt) in which a direct current voltage U1 and a radio-frequency voltage V1·cos ωt are superimposed. A voltage of ±(U3+V3·cos ωt)+Vbias3 is applied to the third-stage quadrupole electrodes 15 from another RF+DC+Bias voltage generator 33, in which a predetermined direct current bias voltage Vbias3 is further added to a voltage of ±(U3+V3·cos ωt) in which a direct current voltage U3 and a radio-frequency voltage V3·cos ωt are superimposed. This is a conventional method.

A voltage of $V_{Bias}+V_{RF}$ in which a direct current bias voltage $V_{Bias}$ and a radio-frequency voltage $V_{RF}$ (=V·cos Ωt) are superimposed or a voltage of $V_{Bias}-V_{RF}$ in which the same direct current bias voltage $V_{Bias}$ and a radio-frequency voltage having a reversed polarity to the radio-frequency voltage $V_{RF}$ is applied to the eight rod electrodes which compose the ion guide 20. A detailed explanation will be made later.

In such a configuration, it is known that the pseudopotential Vp(R), which is formed in the space surrounded by the radio-frequency ion guide 20, at the position (the distance from the ion optical axis C in the radial direction) R is expressed by the following equation (1):

$$Vp(R)=\{q^2n^2/(4m\Omega^2)\}\cdot(V/r)^2\cdot(R/r)^{2(n-1)} \quad (1)$$

where, r is the radius of the inscribed circle of the ion guide, Ω is the frequency of the radio-frequency voltage, V is the amplitude of the radio-frequency voltage, n is the number of poles of the ion guide, m is the mass of the ion, and q is the electric charge. That is, it is understood that any one of the ion guide's inscribed circle's radius r, radio-frequency voltage's frequency Ω or amplitude V, and the number of poles of the ion guide n may be changed along the direction of the ion optical axis so that the pseudopotential Vp(R) should be changed along the ion optical axis. In the case where the magnitude or depth of the pseudopotential has a gradient, an ion having a charge is accelerated or decelerated in accordance with the gradient. Hence, if the gradient is appropriately formed, an ion can be accelerated while passing through the radio-frequency ion guide.

In the configuration of the first embodiment, as illustrated in FIG. 2, eight cylindrical (or tubular) rod electrodes 21 through 28 are arranged to surround the ion optical axis C. Each of the rod electrodes 21 through 28 is inclined with respect to the ion optical axis C in such a manner that the radius of the inscribed circle 29*a* at the ion injection end's side is r1, and the radius of the inscribed circle 29*b* at the ion exit end's side is r2 (>r1). That is, the radius of the inscribed circle gradually increases in the ion's traveling direction (from left to right in FIG. 2(*a*)).

For the eight rod electrodes 21 through 28, four alternate electrodes in the circumferential direction centering on the ion optical axis C are considered to be a single group. A voltage of $V_{Bias}+V_{RF}$ is applied to the four rod electrodes 21, 23, 25, and 27, which belong to one group, from an RF+Bias voltage generator 32, and a voltage of $V_{Bias}-V_{RF}$ is applied to the four rod electrodes 22, 24, 26, and 28, which belong to the other group, from the same RF+Bias voltage generator 32. The application of the radio-frequency voltage $V_{RF}$ forms a radio-frequency electric field in the space surrounded by the eight rod electrodes 21 through 28. Since each of the rod electrodes 21 through 28 is placed at a tilt as previously described, the gradient of the depth of the pseudopotential is formed in the ion's traveling direction.

In the collision cell 14, a radio-frequency electric field is formed by the radio-frequency ion guide 20 as previously described, and ions are captured by the action of this radio-frequency electric field. A precursor ion collides with a CID gas, and due to the collision energy, the bond of the precursor ion is cut to be dissociated. Since there are generally many types of dissociation, the product ions generated from one species by a dissociation is not always limited to one species. Although a portion of the kinetic energy that a precursor ion originally has possessed is lost due to a collision with the CID gas, a kinetic energy is given by the gradient of the depth of the pseudopotential formed in the internal space of the radio-frequency ion guide 20 as previously described. Consequently, a precursor ion and product ion which have lost some kinetic energy due to a collision with the CID gas are accelerated once again, smoothly progress toward the ion exit aperture 14*b* without stagnating in the collision cell 14, and are expelled from the collision cell 14 via the ion exit aperture 14*b*.

As just described, with the MS/MS mass spectrometer according to the present invention, it is possible to prevent the delay and stagnation of ions in the collision cell 14 by using the gradient of the magnitude or depth of the pseudopotential formed in the radio-frequency ion guide 20. Consequently, the product ions originating from the precursor ion to be targeted are introduced into the third-stage quadrupole electrodes 15 without a significant delay and then mass separated. Accordingly, many product ions can be sent into the detector 16, which ensures a high detection sensitivity. In addition, since ions do not stagnate in the collision cell 14, the generation of a ghost peak in a mass spectrum can also be prevented.

Figure 9:
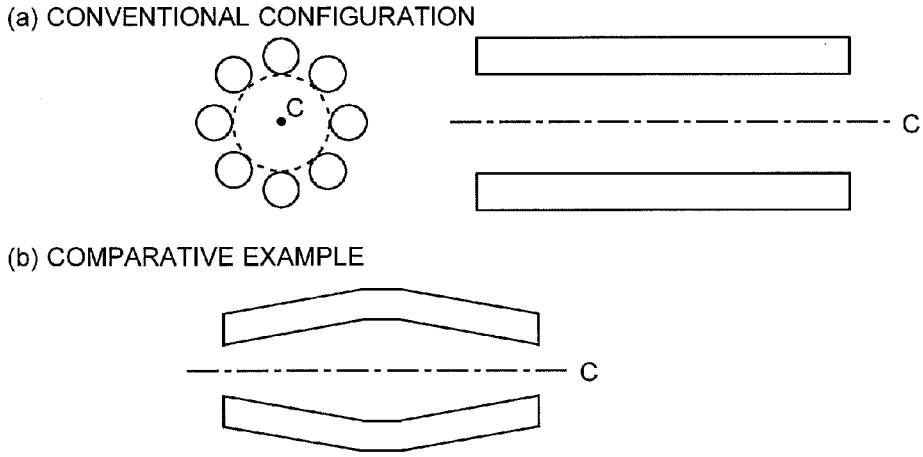
FIG. 9 illustrates schematic configuration diagrams of radio-frequency ion guides, one of which is a conventional example and the other a comparative example for the present invention.

The inventors of the present invention have experimentally confirmed the previously described effect of the pseudopotential. The experiment will now be explained. In this experiment, the speed of the expelled ions has been measured for the following three configurations as experimental objects: the configuration of the present embodiment as illustrated in FIG. 2, the conventional configuration (in which each rod electrode is arranged in parallel with the ion optical axis C) as illustrated in FIG. 9(*a*), and the configuration of the comparative example (i.e. a barrel-shaped configuration in which the central region in the longitudinal direction is curved outward) as illustrated in FIG. 9(*b*). All these configurations use an octapole-type ion guide. The configuration of the comparative example of FIG. 9(*b*) is capable of holding ions around the center of the rod electrodes by the pseudopotential gradient from both ends of the rod electrodes toward the center in the longitudinal direction (refer to Andrew Krutchinsky et al., "A novel high-capacity ion trap-quadrupole tandem mass spectrometer," International Journal of Mass Spectrometry, pp. 93-105, 268 (2007)).

Figure 10:
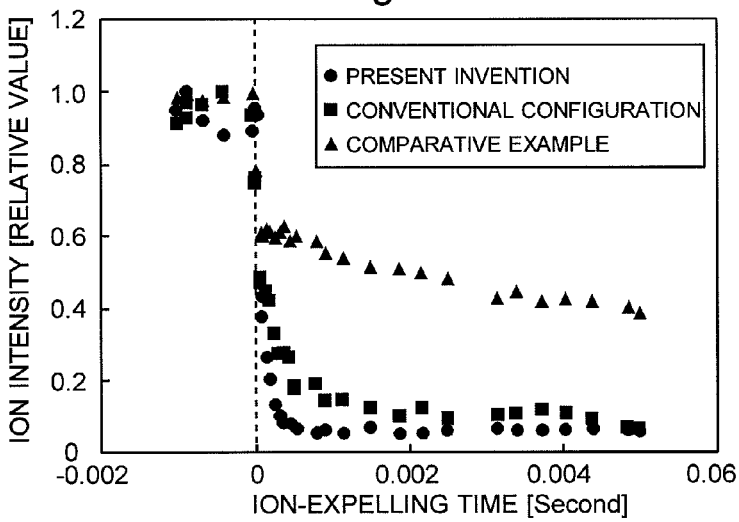
FIG. 10 is a graph illustrating the result of an actual measurement of the relationship between the ion-expelling time and the relative intensity in the radio-frequency ion guide according to the first embodiment and the ion guides illustrated in FIG. 9.

FIG. 10 is a graph illustrating the actual measurement of the change in the detection intensity of the product ions originating from a precursor ion, after continuously injecting a precursor ion into the collision cell until the point in time t=0 and the injection is halted at the point in time t=0. In this experiment, a faster decline in the detection intensity signifies a smaller magnitude of the ion's delay. FIG. 10 illustrates that the ions are expelled faster in the configuration of the present embodiment as illustrated in FIG. 2 compared to the conventional configuration and the configuration of the comparative example. This experimental result shows that forming a gradient of the magnitude or depth of the pseudopotential as in the present embodiment and thereby accelerating an ion are effective in preventing an ion's delay.

Next, the radio-frequency ion guides in other embodiments having the same effect as the radio-frequency ion guide 20 adopted in the MS/MS mass spectrometer according to the first embodiment will be described with reference to FIGS. 3 through 8.

Second Embodiment

Figure 3:
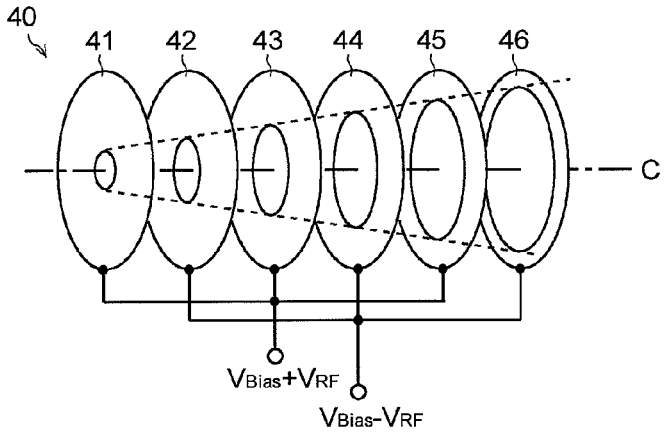
FIG. 3 is a schematic configuration diagram of a radio-frequency ion guide according to another embodiment (the second embodiment).

The radio-frequency ion guide 40 illustrated in FIG. 3 is composed of a plurality (six in this example) of plate electrodes 41 through 46 arranged along the ion optical axis C. Each of the plate electrodes 41 through 46 has a circular opening centering on the ion optical axis C, and the radius of the opening increases in a stepwise manner toward the ion's traveling direction. This electrode design is similar to that of the first embodiment in which the radius of the inscribed circle of a plurality of rod electrodes gradually increases, and hence brings about the same effect as in the first embodiment. In this case, the radio-frequency voltage $V_{RF}$ is applied to the plate electrodes in such a manner that the polarity is reversed for two electrodes neighboring along the ion optical axis C.

Third Embodiment

Figure 4:
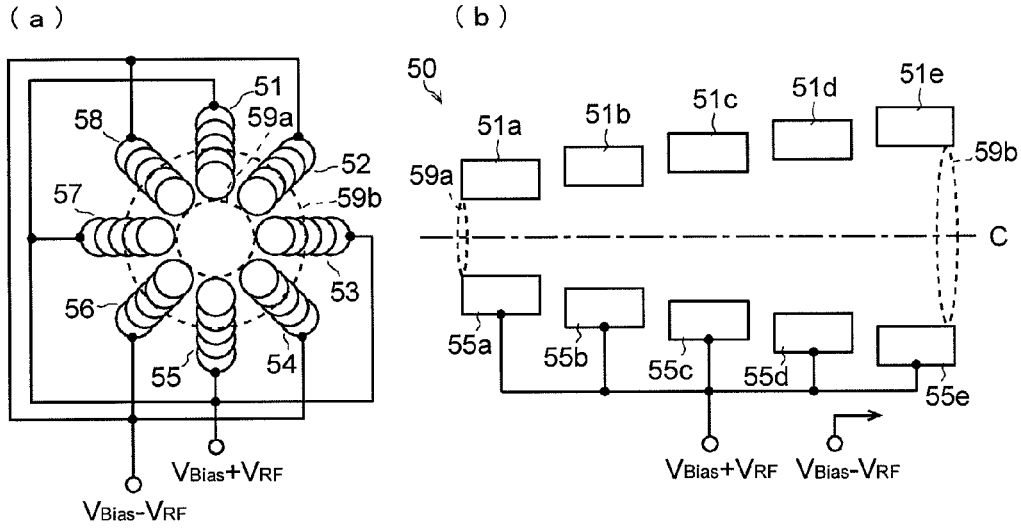
FIG. 4 illustrates a radio-frequency ion guide according to another embodiment (the third embodiment): (a) a left side elevational view and (b) front end elevational view.

The radio-frequency ion guide 50 illustrated in FIG. 4 can be considered to be composed of eight rod electrodes disposed in such a manner as to surround the ion optical axis C as in the first embodiment. However, the substance of each rod electrode is not a single electrode but a virtual rod electrode (e.g. numeral 51) composed of a plurality (five in this example) of segmented rod electrodes (e.g. numerals 51*a* through 51*e*) which are separated in the direction of the ion optical axis C. That is, eight virtual rod electrodes 51 through 58 are disposed in such a manner as to surround the ion optical axis C. In each of the virtual rod electrodes 51 through 58, the segmented rod electrodes (e.g. numerals 51*a* through 51*e*) are disposed in such a manner that their distance from the ion optical axis C increases in a stepwise manner toward the ion's traveling direction. Therefore, the magnitude or depth of the pseudopotential does not have a smoothly slanted gradient as in the first embodiment but a stepwise gradient, which brings about the same effect as the first embodiment.

Fourth Embodiment

Figure 5:
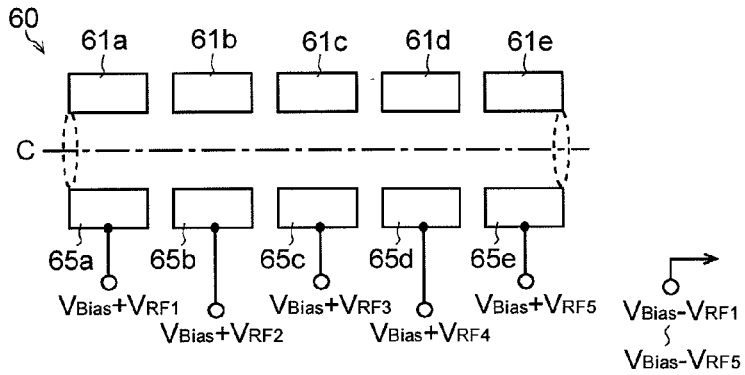
FIG. 5 is a front end elevational view of a radio-frequency ion guide according to another embodiment (the fourth embodiment).

The radio-frequency ion guide 60 illustrated in FIG. 5 is composed of the virtual rod electrodes composed of a plurality of segmented rod electrodes arranged in such a manner as to surround the ion optical axis C as in the third embodiment. (Although only two rod electrodes specified by numerals 61 and 65 are shown in FIG. 5, eight rod electrodes exist as in the third embodiment.) However, the distance between the ion optical axis C and each of the segmented rod electrodes which belong to the same virtual rod electrode is the same. That is, the radius of the inscribed circle of the virtual rod electrodes is the same at any position along the ion optical axis C. Instead, different radio-frequency voltages $V_{RF1}$ through $V_{RF5}$ are applied to each of the plurality of segmented rod electrodes (e.g. numerals 65*a* through 65*e*) which belong to the same virtual rod electrode. Either one or both of the frequency and amplitude of these radio-frequency voltages $V_{RF1}$ through $V_{RF5}$ are changed in a stepwise manner in order to form the gradient of the magnitude or depth of the pseudopotential.

Fifth Embodiment

Figure 6:
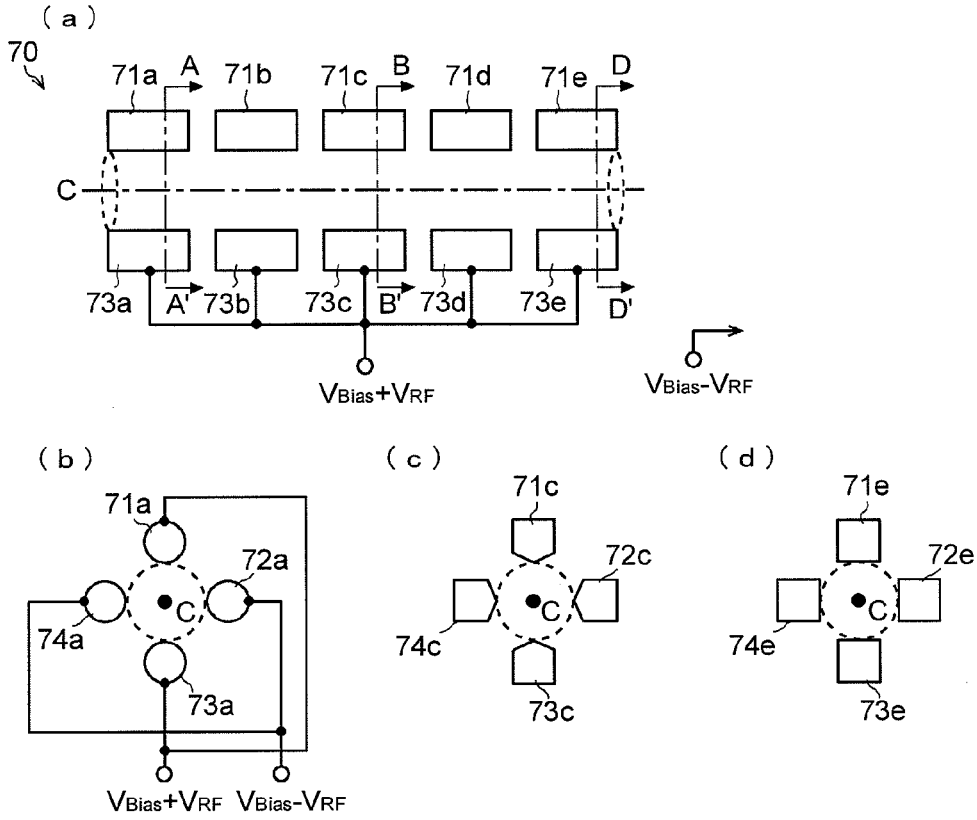
FIG. 6(*a*) is a front end elevational view of a radio-frequency ion guide according to another embodiment (the fifth embodiment), and FIG. 6(*b*), FIG. 6(*c*), and FIG. 6(*d*) are an end view of the same radio-frequency ion guide viewed from the arrow A-A', B-B', and C-C' of FIG. 6(*a*) respectively.

The ion guide 70 illustrated in FIG. 6 is composed of the four virtual rod electrodes 71 through 74 arranged in such a manner as to surround the ion optical axis C, where each virtual rod electrode is composed of a plurality of segmented rod electrodes as in the fourth embodiment. However, the same radio-frequency voltage $V_{RF}$ is applied to the plurality of segmented rod electrodes which belong to the same virtual rod electrode. Instead, the plurality of segmented rod electrodes include one having a different cross-sectional shape. Specifically, in the virtual rod electrode 71 for example, the segmented rod electrodes 71*a* and 71*b* have a circular cross section, the segmented rod electrodes 71*c* and 71*d* have a pentagonal cross section, and the segmented rod electrode 71*e* has a square cross section.

In the case where the segmented rod electrodes have different cross-sectional shapes, to be more precise, where some have a cross-sectional shape other than a circle, pseudopotential terms of poles other than the n poles are superimposed in the equation (1), which changes the pseudopotential's shape. Accordingly, a substantial gradient is formed in the magnitude or depth of the pseudopotential, which brings about the same effect as the first embodiment.

Sixth Embodiment

Figure 7:
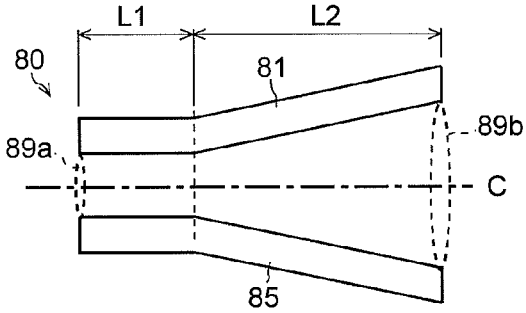
FIG. 7 is a front end elevational view of a radio-frequency ion guide according to another embodiment (the sixth embodiment).

In the radio-frequency ion guide 80 illustrated in FIG. 7, rod electrodes themselves are bent halfway. (Although only the numerals 81 and 85 are shown in the figure, eight rod electrodes exist as in the first embodiment.) Accordingly, the radius of the inscribed circle 89*b* at the side of the ion exit end is larger than that of the inscribed circle 89*a* at the side of the ion injection end. In the range L1 where the rod electrodes are in parallel to the ion optical axis C, the pseudopotential does not have a gradient: however, in the range L2 where the rod electrodes are tilted with respect to the ion optical axis C, the pseudopotential has a gradient as in the first embodiment. Therefore, this configuration basically brings about the same effect as the first embodiment.

Seventh Embodiment

Figure 8:
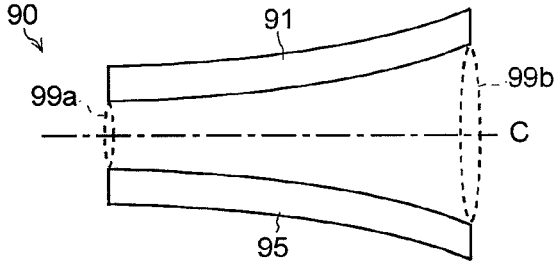
FIG. 8 is a front end elevational view of a radio-frequency ion guide according to another embodiment (the seventh embodiment).

In the radio-frequency ion guide 90 illustrated in FIG. 8, rod electrodes themselves are curved. (Although only the numerals 91 and 95 are shown in the figure, eight rod electrodes exist as in the first embodiment.) Accordingly, the radius of the inscribed circle 99*b* at the side of the ion exit end is larger than that of the inscribed circle 99*a* at the side of the ion injection end. In addition, it is ensured that the radius gradually increases in the ion's traveling direction. Therefore, this configuration basically brings about the same effect as the first embodiment.

In the aforementioned examples, the radio-frequency ion guide which is characteristic of the present invention is provided in the collision cell. In the same manner, the radio-frequency ion guide may be provided in the portion where ions need to be converged under a relatively high gas pressure and transported to the subsequent stage.

In particular, an LC/MS or other apparatuses often adopt a multiple-stage differential evacuation system in which a plurality of intermediate vacuum chambers are disposed between the atmospheric pressure ionization interface such as an electrospray ionization interface and the analysis chamber containing a mass separator and detector in a high vacuum atmosphere. In this case, inside the intermediate vacuum chamber that immediately follows the atmospheric pressure ionization interface, the gas pressure is relatively high due to the air flowing in from the atmospheric pressure ionization interface, and an ion is likely to be decelerated due to the effect of the air. Therefore, the provision of the radio-frequency ion guide as previously described in such an intermediate vacuum chamber to increase the ion's passage efficiency increases the ion's detection sensitivity.

It should be noted that every embodiment described thus far is merely an embodiment of the present invention, and that any modification, addition or correction appropriately made within the spirit of the present invention will be included in the scope of the claims of the present application.

The invention claimed is:

1. An ion guide for converging ions by a radio-frequency electric field and simultaneously transporting the ions comprising:

electrodes surrounding an ion optical axis, and each electrode has a titled portion such that a radius of an inscribed circle of the electrodes increases toward an ion's traveling direction, thereby the ion guide forms a gradient of a magnitude or depth of a pseudopotential by the radio-frequency electric field along the ion's traveling direction, and the ion is accelerated in the traveling direction in accordance with the gradient.

2. The ion guide according to claim 1, wherein the electrodes comprise a plurality of rod electrodes surrounding the optical axis.

3. The ion guide according to claim 2, wherein the rod electrodes are linearly-extending, and each rod electrode is disposed at a tilt in such a manner that a distance from the ion optical axis increases toward the ion's traveling direction.

4. The ion guide according to claim 1, wherein the electrodes comprise a plurality of plate electrodes arranged in a direction of the ion optical axis, and each plate electrode has a circular opening whose radius centering on the ion optical axis increases toward an ion's traveling direction.

5. The ion guide according to claim 1, wherein the electrodes comprise a plurality of virtual rod electrodes surrounding the ion optical axis, each virtual rod electrode comprising a plurality of short segmented rod electrodes spaced in a direction of the ion optical axis, and the plurality of segmented rod electrodes belonging to a same virtual rod electrode are disposed in such a manner that a distance from the ion optical axis increases toward the ion's traveling direction.

6. An ion guide for converging ions by a radio-frequency electric field and simultaneously transporting the ions, comprising:

a plurality of virtual rod electrodes surrounding an ion optical axis, each virtual rod electrode comprising a plurality of short segmented rod electrodes spaced in a direction of the ion optical axis, and a radio-frequency voltage whose amplitude or frequency is different is applied to the plurality of segmented rod electrodes belonging to a same virtual rod electrode, thereby the ion guide forms a gradient of a magnitude or depth of a pseudopotential by the radio-frequency electric field along an ion's traveling direction, and the ion is accelerated in the traveling direction in accordance with the gradient.

7. An ion guide for converging ions by a radio-frequency electric field and simultaneously transporting the ions, comprising:

a plurality of virtual rod electrodes surrounding an ion optical axis, each virtual rod electrode comprising a plurality of short segmented rod electrodes spaced in a direction of the ion optical axis, and the plurality of segmented rod electrodes belonging to a same virtual rod electrode have a different cross-sectional shape;

thereby the ion guide forms a gradient of a magnitude or depth of a pseudopotential by the radio-frequency electric field along an ion's traveling direction, and the ion is accelerated in the traveling direction in accordance with the gradient.

8. A collision cell comprising the ion guide according to claim 1.

9. A tandem mass spectrometer, comprising:

the ion guide according to claim 1;

an analysis chamber; and a region having a higher pressure than that of the analysis chamber;

the ion guide being provided inside the region having the higher pressure than that of the analysis chamber.

10. The tandem mass spectrometer according to claim 9, wherein the tandem mass spectrometer is a hybrid mass spectrometer.

11. A collision cell comprising the ion guide according to claim 6.

12. A tandem mass spectrometer, comprising:

the ion guide according to claim 6;

an analysis chamber; and a region having a higher pressure than that of the analysis chamber;

the ion guide being provided inside the region having the higher pressure than that of the analysis chamber.

13. The tandem mass spectrometer according to claim 12, wherein the tandem mass spectrometer is a hybrid mass spectrometer.

14. A collision cell comprising the ion guide according to claim 7.

15. A tandem mass spectrometer, comprising:

the ion guide according to claim 7;

an analysis chamber; and a region having a higher pressure than that of the analysis chamber;

the ion guide being provided inside the region having the higher pressure than that of the analysis chamber.

16. The tandem mass spectrometer according to claim 15, wherein the tandem mass spectrometer is a hybrid mass spectrometer.

* * * * *